US005547138A

United States Patent [19]

Claut et al.

[11] Patent Number: 5,547,138

[45] Date of Patent: Aug. 20, 1996

[54] BOBBIN WINDING METHOD AND WINDING MACHINES FOR YARN WINDING AFTER CONTROLLED CUTTING OF THE YARN

[75] Inventors: Demetrio Claut, Montereale Valcellina; Nereo Marangone; Roberto Badiali, both of Pordenone, all of Italy

[73] Assignee: Savio Macchine Tessili S.r.l., Pordenone, Italy

[21] Appl. No.: 247,278

[22] Filed: May 23, 1994

[30] Foreign Application Priority Data

May 28, 1993 [IT] Italy ..... MI93A1110
May 28, 1993 [IT] Italy ..... MI93A1111

[51] Int. Cl.[6] ..... B65H 63/00; B65H 54/38

[52] U.S. Cl. ..... 242/36; 242/37 R; 242/18 EW

[58] Field of Search ..... 242/36, 37 R, 242/18 EW

[56] References Cited

U.S. PATENT DOCUMENTS

| | | | |
|---|---|---|---|
| 3,751,898 | 8/1973 | Inaba et al. | 342/18 EW X |
| 4,214,717 | 7/1980 | Makino et al. | 242/36 |
| 4,315,607 | 2/1982 | Felix | 242/36 |
| 4,324,368 | 4/1982 | Inouye et al. | 242/18 EW |
| 4,330,094 | 5/1982 | Mayer | 242/36 |
| 5,074,480 | 12/1991 | Aeppli | 242/36 |
| 5,259,179 | 11/1993 | Sekiya et al. | 57/264 |
| 5,348,242 | 9/1994 | Bauer et al. | 242/18 EW |
| 5,426,929 | 6/1995 | Schwalm et al. | 242/18 EW |

FOREIGN PATENT DOCUMENTS

| | | | |
|---|---|---|---|
| 3906474 | 9/1990 | Germany | 242/36 |
| 127568 | 5/1989 | Japan | 242/36 |

*Primary Examiner*—William Stryjewski
*Attorney, Agent, or Firm*—Oblon, Spivak, McClelland, Maier & Neustadt, P.C.

[57] ABSTRACT

A method and device for winding yarn into bobbins, in an automatic winding machine in which the yarn is cut on command so that the cut end is wound onto the central portion of the surface of the bobbin under formation, in order to facilitate restoration of yam continuity and restarting of winding.

10 Claims, 4 Drawing Sheets

24
22
23
20
21
3
14
2
10
26
12
25
6
1
27
29
28
16
30
4
7
5

11
15
38
38a
38b
37
31
35
33
32
6
34
14
12
2
3
19
10
36
5a
5b
9
1
8
7 8 9 / C
4 5 6 X E
1 2 3 + M
0 . = - 0
16
4
7
5
18

24
22
23
20
21
3
14
2
10
26
25
1
29
27
28
16
30
4
7
5

BOBBIN WINDING METHOD AND WINDING MACHINES FOR YARN WINDING AFTER CONTROLLED CUTTING OF THE YARN

BACKGROUND OF THE INVENTION

1. Field of the Invention

This invention relates to an improved method for collecting yarn in automatic winding machines provided with guide members for the yarn being wound, which deposit the yarn in the form of bobbins on which the yarn is wound along a traversing path.

The invention relates particularly to yarn winding after its controlled cutting, this winding being required to take place within the central portion of the bobbin.

2. Discussion of the Background

It is known in the art that winding machines in general, and bobbin winding machines in particular, are provided with bobbin carrying arms. These arms consist essentially of a mandrel formed from a fixed fixing center and a movable fixing center, the purpose of which is to carry, center and fix the tube onto which the yarn is wound to form the bobbin, and to allow regular yarn winding.

The bobbin assumes either substantially cylindrical or substantially frusto-conical shapes. Frusto-conical shapes .are often formed in order to facilitate yarn unwinding during the subsequent fabric manufacture stages.

At each request for controlled yarn cutting it can occur that the yarn end is winding onto one of the two ends of the bobbin under formation and, quite frequently, the yarn—having its cut end suddenly without tension and uncontrolled—is deposited in the form of several turns about one of the fixing centers of the yarn carrying mandrel. Alternatively, that yarn portion which escapes from the side of a frusto-conical bobbin is deposited about the circumferential gripping line between the fixing center and the end of the tube.

During the next joining or knotting cycle it can occur that not all the yarn turns wound on the fixing center are gripped, unwound and removed by the suction port, on restarting the winding process the bobbin under formation again accumulates wound yarn, but there remains the presence of a more or less lengthy yarn portion extending beyond the side of the bobbin.

Even worse the suction port may be unable to suck-in the yarn end because it is too distant. The unit is then compelled to stop, to interrupt the winding process and to require the assistance of a service operator. The cost of this assistance and the reduction in the machine service factor considerably influence the production cost calculations. The efficiency of service operators is very low due to the randomness of the operations as opposed to programmed intervention.

A further serious drawback arises from the yarn portions extending outside the bobbin, which can compromise correct use of the .bobbin during its unwinding in subsequent processing.

SUMMARY OF THE INVENTION

The object of the present invention is to remedy the aforesaid drawbacks by providing a method and devices for its implementation, which enables controlled yarn cutting to be effected at the required moment and the cut yarn to be deposited within a central portion of the bobbin under formation. The invention is directed towards eliminating portions extending outwards from the bobbin sides following controlled cutting and preventing the yarn end from becoming positioned in regions close to its ends.

The improved yarn winding method of the present invention consists of measuring the instantaneous axial position of the yarn guide and determining moment by moment the angular position of the winding yarn during its continuous to-and-fro traversing movement. It also provides continuous and simultaneous measurement both of the winding speed—using a probe disc keyed onto the shaft of the bobbin drive roller—and the transverse speed of the yarn guide element. Hence a control unit based on a minicomputer can provide the yarn cutting request signal, on detecting the presence of a defect in the yarn, on the basis of the instantaneous winding parameters and the characteristic values of the type of yarn processed and of the length of the end remaining free on cutting. In this manner the precise moment of cutting which enables yarn end to be wound onto a central portion of the bobbin under formation can be determined. In other words, the delay which has to take place between the cutting request and its implementation is exactly determined at any given time.

The characteristic values of the winding yarn are those values indicative of its elasticity and count. They are fed into the machine control unit via a control keyboard at the commencement of a new process. The length of the free end on cutting is the distance between the cutting means and the upper winding point. The invention is described hereinafter in terms of a typical implementation in a bobbin winding machine in which the bobbin drive roller is provided with yam guide grooves for controlling traversing, as shown in FIGS. 1 and 2.

Typically, yarn winding is carried out at very high speed, on the order of 1000 m/min or more, meaning that the yarn clearer is traversed by the yarn at a speed of the order of 20 m/sec.

In this embodiment the control unit is a minicomputer which processes the electrical pulses generated by the probe disc to measure the roller revolutions or revolution fractions, and the pulses generated by a proximity sensor which identifies the position of the yam within its continuous to-and-fro traversing.

In one embodiment the probe disc is used as a transducer for the effective yarn winding speed, as a transducer for the yarn length effectively wound per unit of time, and for measuring the angular position of the drive roller for the bobbin under formation.

In a further embodiment the said yarn proximity sensor is used as a transducer for the axial position, moment by moment, of the yam winding point on the bobbin surface.

The apparatus of the present invention, in the sense of a coordinated assembly of sensing means, control and processing units and operating members, can also be advantageously associated with members for regularizing the winding process, such as bobbin modulation members for preventing the formation of ribbing on the bobbin.

DESCRIPTION OF THE PREFERRED EMBODIMENTS

Figure 1:
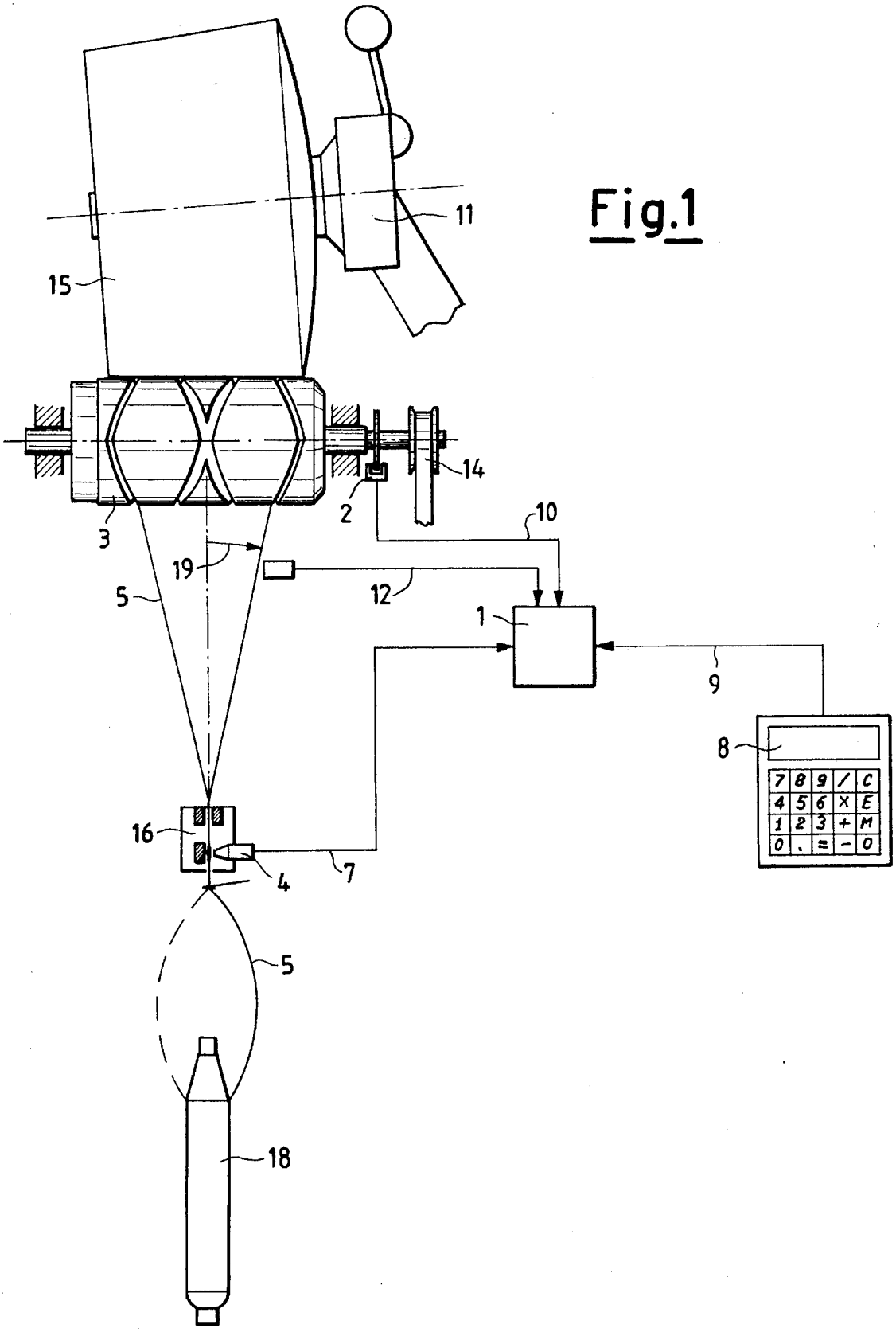
FIG. 1 shows the implementation of the invention in a bobbin winding machine with a yam guide roller, and represents a schematic front view of the winding unit with the means for measuring the winding parameters and the connection lines to the control and, processing unit.

In the various figures the same reference numerals correspond to equal elements. The figures show the following constituent elements:

14 is the toothed transmission belt between the drive source (not shown) and the drive roller 3 provided with a yarn guide groove;

15 is the bobbin under formation, wound with crossed yarn by the simultaneous action of the yarn guide element and the rotational drive by the roller 3;

11 is the bobbin carrying arm which maintains the bobbin 15 in position as its diameter increases, the drive roller 3 transmitting both rotary motion to the bobbin and reciprocating axial movement—by virtue of its grooves—to the yarn 5 fed to the bobbin;

2 is the probe disc which measures moment by moment the rotational speed of the roller 3 during the entire bobbin formation process;

18 is the unwinding package which feeds the yarn 5;

6 as a proximity sensor, for example of an inductive or similar type, to determine the angular position—in the plane of the figure—of the yarn 5 under rapid periodic reciprocating movement;

4 is a sensor, or clearer, for monitoring the yarn an order to detect and evaluate the defects in the yarn running within it. On detecting yarn defects 30 exceeding a preset threshold value the sensor 4 emits cutting command pulses;

1 as the control unit based on a minicomputer or electronic card able to memorize and implement the instructions of the operator, which are fed in via the control keyboard 8. Said unit 1 is arranged to transform the instructions originating from the cable 9 into a program executed in its computing and processing center in order to provide moment by moment the signals required during the winding process. Typically the unit 1 comprises a microprocessor which uses input beth the information from the sensors 4 and 6 via the cables 7 and 12 and the information from the probe 2 via the cable 10, to feed the cutting pulse to the elements of the block 16 each time the yarn 5 shows an undesirable defect. The control unit is also fed with data concerning the quality of the bobbin to be produced. Such data typically consist of the bobbin geometrical values and the values of undesirable defects to be eliminated during winding. The minicomputer serving each winding unit as connected to the central control or processing unit of the overall machine, in which the control keyboard is located.

In the following description of the method, reference is made mainly to its novel aspects within the framework of a single winding unit associated with the means for determining the exact moment of cutting and its implementation.

In an automatic bobbin winding machine consisting of a number of winding units arranged side by side, the yarns from the feed packages are collected in the form of a cross-turn bobbin 15 to be used in subsequent processing. Simultaneously with the transfer of yarn from the package 18 to the bobbin 15, the yarn is subjected to scanning or monitoring by the control block 16 which in a preferred embodiment of the invention can be an electronic yarn clearer, already known in the art.

Yarn clearing members are used in bobbin winding to remove any portions of the yarn running into the winding machine at high speed which comprise defects 30 in terms of the transverse dimension of the yarn.

Such defects relate to yarn portions which locally fall outside a determined count range and/or show substantial count variations which, however, lie within said range but extend over a significant length or occur with an unacceptable frequency.

For inserting the parameters required for detecting and analyzing defects, analysis circuits are provided connected to the feeler means or sensor 4, which unequivocally feeds one or more electrical sensor pulse to the control unit 1 via the cable 7. Said pulse is advantageously preamplified to relate the same to and process the same with the electrical pulses generated by the proximity sensor 6 and by the probe disc 2, and with the characteristic values of the yarn 5 and of the type of bobbin 15 to be obtained. All the arriving pulses are compared and processed moment by moment in the computing center of the minicomputer.

The electronic yarn clearing block or device 16 can be of conventional construction and can contain an electrical or capacitive transducer as the feeler or scanner device. It produces an electrical feeler signal corresponding to a transverse dimension, i.e., an instantaneous cross-section or diameter, or a count or mass per unit length of yarn.

This signal is preamplified—in direct current or alternating current—and fed to the measurement part. Said part normally comprises circuits in which those signals exceeding a determined threshold value (i.e., an unacceptable defect) or are below this value (i.e., an acceptable defect) are further processed.

The analysis circuit detects, measures and analyzes the defects 30 in the yarn 5 and, when signals corresponding to undesirably large, long or frequent defects arise, produces a determined output pulse which is fed to the control unit 1.

Said control unit 1 processes the cutting request pulse together with the other pulses and values and at a precise moment operates the cutting means of the block 16. The yarn is cut in such a manner as to cause it to wind onto the central region of the bobbin 15, i.e., within the central angular sector 20 defined by the limits 22 and 21 of FIG. 2.

Said central angular sector 20 represents a winding parameter which is also fed into the memory of the minicomputer of the control unit 1. The proximity sensor 6, of a known type, provides an electrical signal, i.e., a control pulse, which corresponds to the instantaneous angular position 24 of the yarn 5 and its direction of movement in the direction of the arrows 23 and 19, or 25.

As stated, the yarn 5 is subjected by the grooves of the roller 3 to rapid angular reciprocation between the ends 28 and 29, these being substantially symmetrical about the vertical center line 27, from which they are spaced by an enclosed angle 26.

The signal provided by the proximity sensor 6 is processed in association with the signal originating from the probe disc 2, which measures the rotational speed of the roller 3 and hence of the yarn collection speed on the bobbin 15 under formation, in order to continuously determine within the unit 1 the time taken by the yarn to undergo the angular movement required to again enter the reference position 29, at which it assumes its minimum distance from the sensor 6.

On passage of an undesirable and unacceptable defect 30, or if a generated cutting request arises (for example because the bobbin is complete), the control unit 1 receives a cutting pulse at its input and calculates in its computing center a precise moment $T_o$ in which to make the cut so that the cut yarn end winds within the central angular sector 20.

This is calculated on the basis of the winding speed, the "catapulting" time Δt for the yarn end, time lags in the operation of the cutting members, the angular position of the yarn and the direction of yarn movement.

The yarn "catapulting" consists of the elastic reaction of the type of yarn being processed, when cut. Following cutting of the yarn 5, its end is subjected to the elastic energy accumulated by the effect of the winding tension. At the moment of cutting, the yarn end between the winding point on the bobbin 15 and the cutting point "catapults" more rapidly than the winding speed. This more or less elastic behavior is a parameter which is predetermined and is fed into the unit 1 by the operator.

Cutting at time $T_o$, which corresponds to the correct position of the yarn within the angular sector 20 at the moment of cutting, can involve a certain time lag between the cutting request signal and the cut itself. This lag is very small but, because of the high linear winding speed, is significant in terms of the length of yarn which passes between the time the defect is detected and the time the cut is effected. According to a preferred embodiment of the invention, the subsequent joining operation is conducted taking account of this possible yarn length, by suitably determining the suction time of the yarn pick-up ports on the bobbin side.

Figure 2:
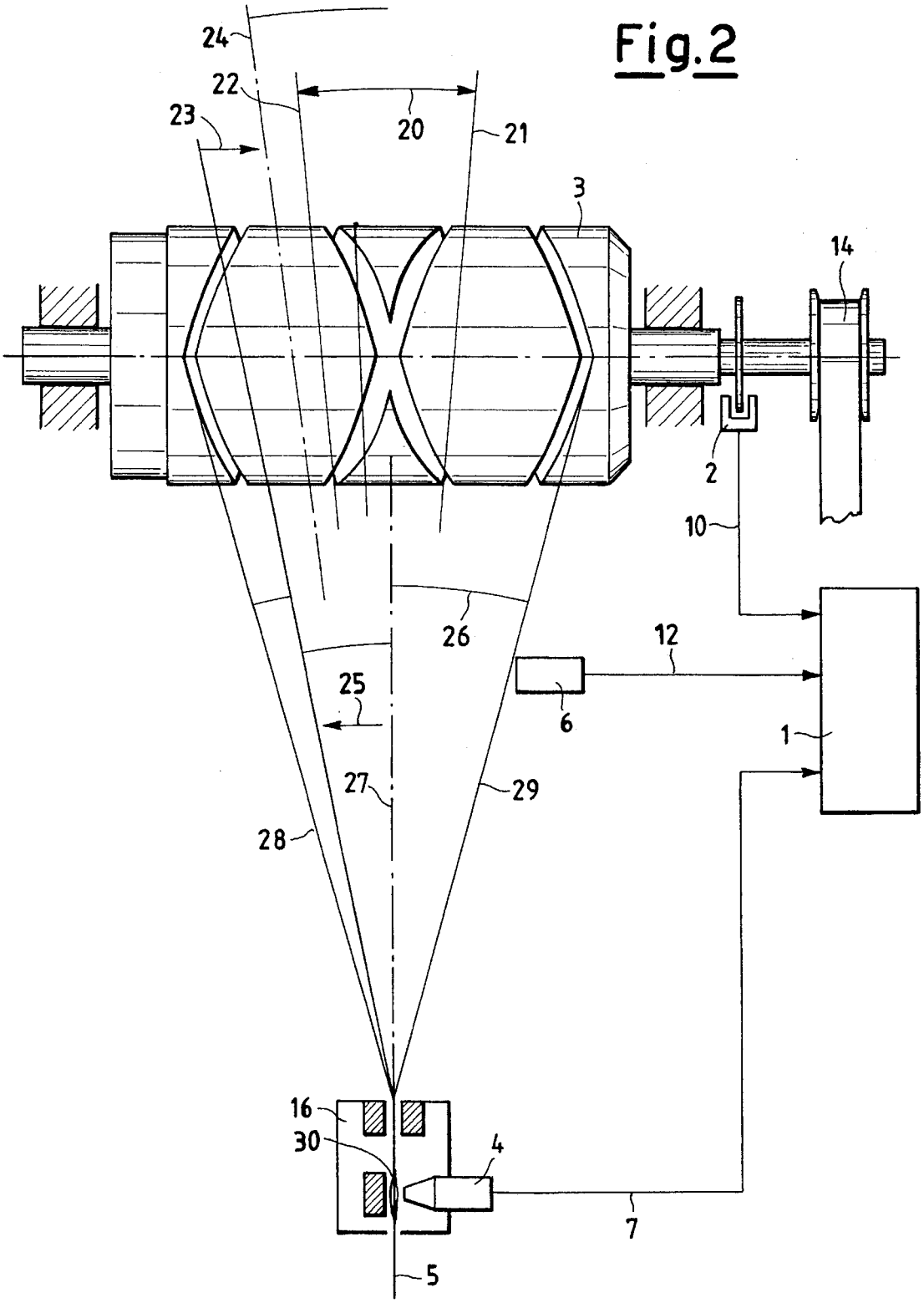
FIG. 2 shows the angular positions of the winding yarn during its to-and-fro movement within the helix of the grooved roller and also shows the presence of a yarn defect which activates the cutting request at a precise moment, such as to enable the cut end to be wound onto the central portion of the bobbin.
Figure 3:
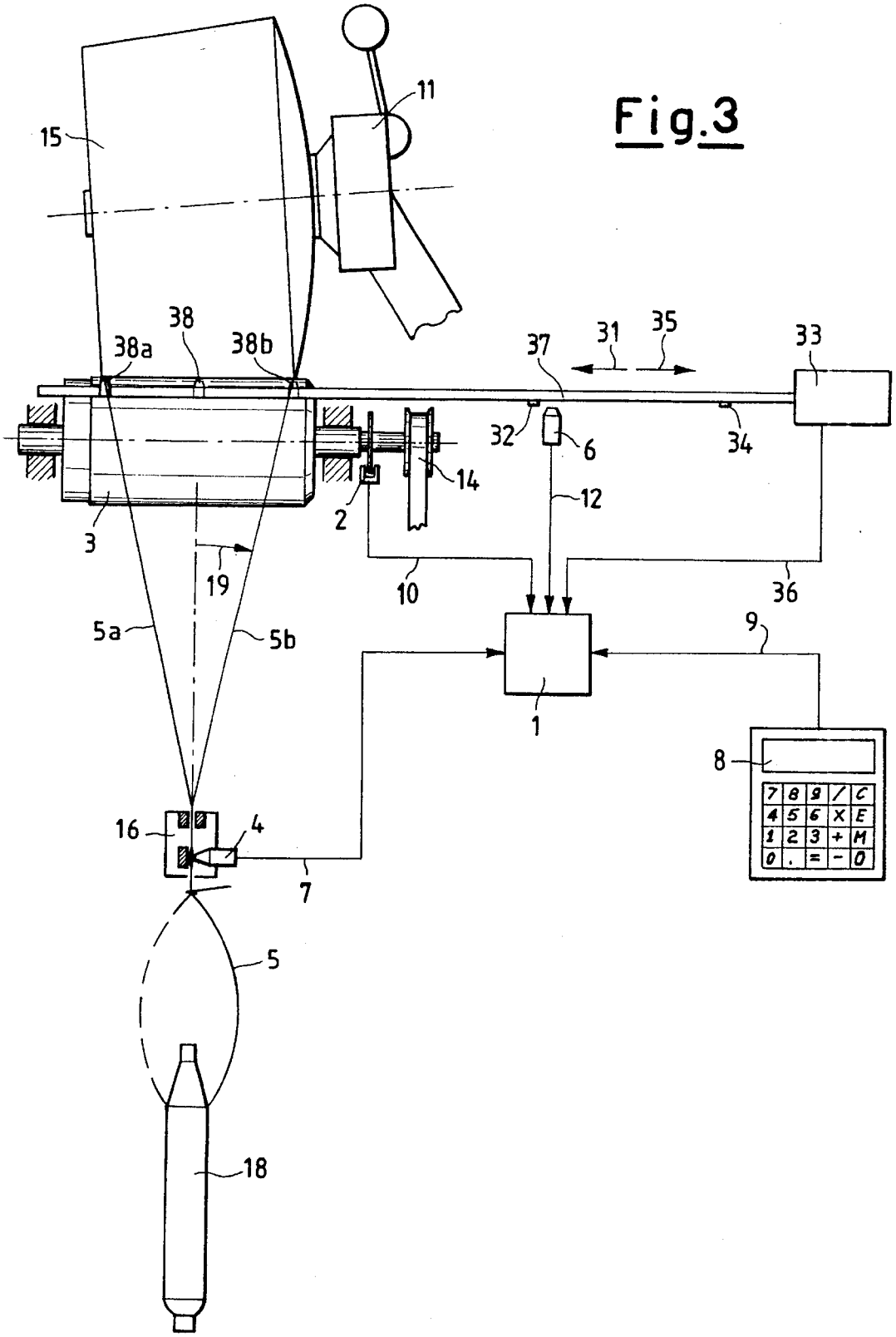
FIGS. 3 and 4 show an alternative embodiment of the bobbin winding machine with a separately operating yarn guide.
Figure 4:
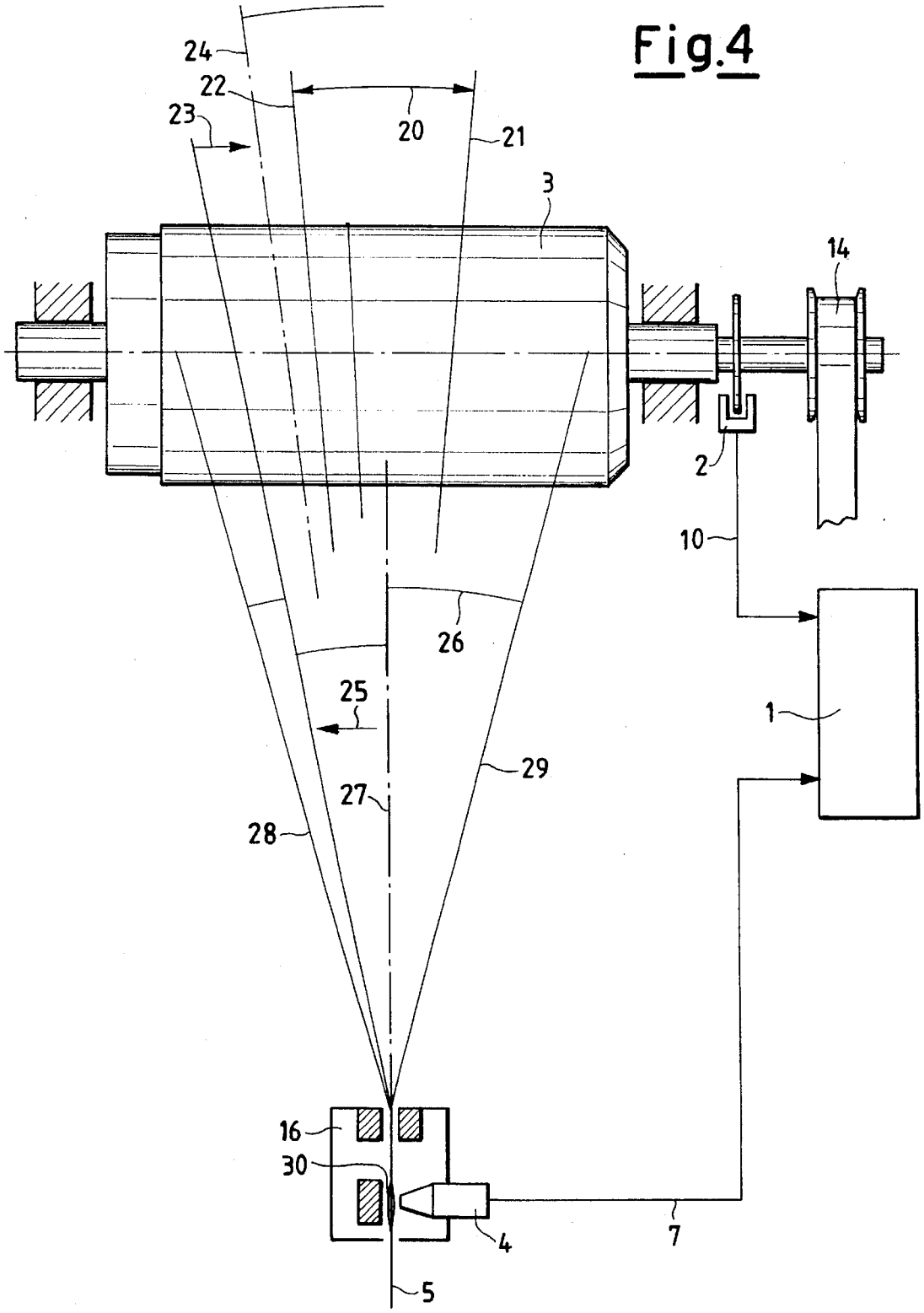

Those members in FIGS. 3 and 4 which have the same significance and function as those described with reference to the embodiment shown in FIGS. 1 and 2 carry the same reference numerals. Those members peculiar to the alternative embodiment are shown, wherein:

33 is a control box containing the drive means for the rod 37, which is driven with periodic transverse reciprocating movement in accordance with the arrows 31 and 35;

on said rod 37 there is fixed as an unseparated body the yarn guide 38, comprising an eyelet for retaining the yarn and for moving it continuously to and fro between the end positions 38*a* and 38*b* of the yarn guide, corresponding to the end positions of the yarn 5*a* and 5*b;* the proximity sensor 6 is in this case located in correspondence with the limit stops 34 and 32 positioned on the rod 37;

the cable 36 connects the control box 33 to the control unit 1.

In this embodiment the moment of yarn cutting is determined on the basis of the position of the yarn guide 38 within the angular sector 20.

The yarn end to be catapulted is that lying between the yarn guide element 38 and the cutting point within the block 16.

Obviously, numerous modifications and variations of the present invention are possible in light of the above teachings. It is therefore to be understood that within the scope of the appended claims, the invention may be practiced otherwise than as specifically described herein.

We claim:

1. A method of collecting yarn on a cross-yarn bobbin of an automatic winding machine having a plurality of side by side winding units in which the yarn is wound on the bobbin by the simultaneous action of a drive roller and a yarn guide element which includes a traversing movement in the yarn, and including a sensor control unit, which comprises:

determining, based upon an input to the control unit from a sensor during winding, the position of the winding yarn on the bobbin under formation, which moment by moment changes an angular position thereof in a frontal plane of the winding machine within an angular sector formed between the yarn guide element and a drive roller sector with continuous to-and-fro reciprocating traversing movement;

continuously and simultaneously measuring both yarn winding speed and traversing speed during traversing movement of the winding yarn;

feeding into the control unit; with continuously measuring the yarn winding speed and yarn traversing speed, characterizing values for the bobbin under formation, said values representing the type of yarn being wound on the bobbin, the desired bobbin quality and a length of yarn left free upon controlled cutting of the yarn as calculated by the control unit;

generating in said control unit, with the feeding of the yarn characterizing values, the required yarn cutting request signals, and cutting the yarn prior to being wound on the bobbin upon detection of an undesirable defect in the yarn, on the basis of said characterizing values for the bobbin under formation, the speed measurements and the yarn angular position determination, so as to calculate a point in time for cutting the yarn such that a yarn end left free after cutting winds onto a central portion of the bobbin within a central angular sector portion of said angular sector; and collecting the yarn on the bobbin.

2. A method of collecting yarn in an automatic winding machine as claimed in claim 1, wherein the characterizing values for the type of yarn being wound comprise values indicative of the elastic behavior of the yarn and a count value of the yarn, said values being predetermined, and feeding said values into the control unit via a control keyboard.

3. A method of collecting yarn in an automatic winding machine as claimed in claim 1, which includes a yarn feeler wherein the characterizing values for the bobbin quality comprise geometrical bobbin values and values representing an allowable yarn count variation range, which comprises:

eliminating, by use of the control unit, yarn portions which locally fall outside one of a determined count range and a present substantial count variation contained within said range, based on the analysis of defects indicated by said yarn feeler wherein said yarn feeler generates electrical pulses communicated to the control unit corresponding to the detection of defects.

4. A winding machine collecting yarn, which comprises:

a plurality of side by side winding units, wherein each unit comprises a measuring mechanism instantaneously measuring the winding and position parameters and the transverse speed of the yarn being wound, a yarn clearing block, a monitoring mechanism monitoring yarn defects, and a controlled yarn cutting mechanism positioned within said yarn clearing block, a control unit programmed with predetermined working parameters for said yarn being wound and receiving signals from the measuring mechanism and monitoring mechansim, wherein a yarn cutting signal is generated from said control unit and provides a control signal to the cutting mechanism such that at a precise moment the yarn is cut so that a cut yarn end thereof winds onto a central portion of the bobbin under formation.

5. A winding machine as claimed in claim 4, wherein the mechanism instantaneously measuring the winding parameters comprises:

a probe disc measuring both rotational speed and the angular position of the drive roller, and a proximity sensor which provides moment by moment a signal identifying the angular position of the winding yarn during traversing reciprocating movement of the winding yarn.

6. A winding machine as claimed in claim 5, wherein the probe disc comprises a transducer determining the effective yarn winding speed, a transducer determining the yarn length wound per unit of time, and an element measuring the angular position of the drive roller.

7. A winding machine as claimed in claim 4, wherein said control unit comprises a proximity sensor which includes a transducer determining the axial position, moment by moment, of the yarn winding point of the bobbin and which generates a signal which is communicated with said control unit.

8. A winding machine as claimed in claim 4, which comprises a proximity sensor wherein the yarn guide element comprises a spiral groove provided on the bobbin drive roller and the proximity sensor comprises a yarn sensor located in proximity with a reverse point of movement of the traversing movement, so that the sensor is at a minimum distance from the yarn when the yarn reaches the reverse movement point.

9. A winding machine as claimed in claim 4, wherein the yarn guide element comprises a yarn guide positioned on a rod driven with reciprocating motion in a direction parallel to an axis of the drive roller and the proximity sensor comprises a sensor operatively associated with two limit stops located on said rod and corresponding to reversing points of the traversing movement, so that the sensor is at a minimum distance from one of the limit stops when the yarn reaches one of the reversing movement points.

10. A winding machine as claimed in claim 4, which comprises a proximity sensor, a control keyboard, a probe disc, a bobbin drive roller and a yarn guide element wherein the control unit of each individual winding unit comprises one of a minicomputer and a microprocessor connected to the machine central control unit into which the data relative to the winding underway are fed via said control keyboard, said minicomputer processing signals generated by said probe disc which measure both revolutions and fractions of revolutions the bobbin drive roller, signals generated by the proximity sensor which identifies the angular position of the yarn during traversing reversing movement thereof, and signals from the mechanism monitoring occurrence of a defect of the yarn, in order to provide the yarn cutting command at the required moment for the cut yarn end to be wound onto a central angular sector portion of an angular sector formed between the yarn guide element and the bobbin drive roller.

* * * * *